US006614148B1

(12) United States Patent
Axelsson et al.

(10) Patent No.: US 6,614,148 B1
(45) Date of Patent: Sep. 2, 2003

(54) SAFETY CONSTRUCTION FOR TUBULAR FLUORESCENT LAMP HAVING SPACER BETWEEN ELECTRODE COVER AND INNER SURFACE OF TUBE

(75) Inventors: Folke Axelsson, Karlskrona (SE); Bo Sabel, Rödeby (SE)

(73) Assignee: Auralight AB, Karlskrona (SE)

( * ) Notice: Subject to any disclaimer, the term of this patent is extended or adjusted under 35 U.S.C. 154(b) by 260 days.

(21) Appl. No.: 09/587,000

(22) Filed: Jun. 5, 2000

(30) Foreign Application Priority Data

Jan. 24, 2000 (SE) ..... 0000194

(51) Int. Cl.[7] ..... H01J 1/88
(52) U.S. Cl. ..... 313/292
(58) Field of Search ..... 313/292, 279, 313/281, 284, 285, 288

(56) References Cited

U.S. PATENT DOCUMENTS 3,560,779 A * 2/1971 May ..... 313/414
4,145,630 A * 3/1979 DeCaro et al. ..... 313/273
4,598,342 A * 7/1986 English et al. ..... 362/213

FOREIGN PATENT DOCUMENTS

| | | |
|---|---|---|
| EP | 0 383 728 | 8/1990 |
| GB | 2 328 075 | 2/1999 |
| WO | WO 81/01344 | 5/1981 |

* cited by examiner

*Primary Examiner*—Vip Patel
*Assistant Examiner*—Kevin Quarterman
(74) *Attorney, Agent, or Firm*—Timothy Platt

(57) ABSTRACT

A tubular fluorescent lamp (2) comprises an electrode (8) mounted inside the glass tube (4) which is at least partly surrounded by an electrode cover (16) mounted inside the glass tube (4) and situated between the electrode (8) and the wall of the glass tube (4) at a distance from them. According to the invention, a spacer (24) is placed in such a way that when the electrode cover (16) unintentionally is moved from its mounting position in a radial direction relative to the longitudinal axis of the glass tube (4), contact occurs between the electrode cover (16) and the spacer (24), and between the spacer (24) and the inside of the wall of the glass tube (4), preventing the movement of the electrode cover (16) before it comes into direct contact with the inside of the wall of the glass tube (4). Thereby is prevented that the tubular fluorescent lamp cracks and may fall out from its fittings. The spacer is preferably a mica plate (24) with larger diameter than the electrode cover (16).

11 Claims, 2 Drawing Sheets

Figure 1:
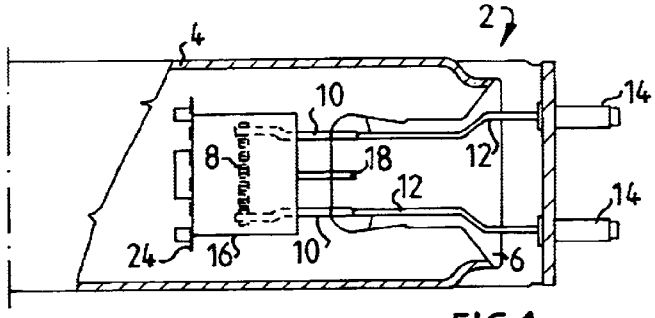

SAFETY CONSTRUCTION FOR TUBULAR FLUORESCENT LAMP HAVING SPACER BETWEEN ELECTRODE COVER AND INNER SURFACE OF TUBE

BACKGROUND FOR THE INVENTION

The present invention relates to a device inside a glass tube in a tubular fluorescent lamp, where the tubular fluorescent lamp comprises an electrode mounted inside the glass tube said electrode being at least partially surrounded by an electrode cover mounted inside the glass tube.

CLOSELY RELATED TECHNOLOGY

JP 56134468 (Patent abstracts of Japan Vol. 006012, Jan. 23, 1982) discloses as previously known a tubular fluorescent lamp which comprises a glass tube and an electrode, where the electrode in its mounting position is placed at a distance from the inside of the wall of the glass tube.

EP 0 555 619 A1 discloses as previously known a tubular fluorescent lamp which comprises a glass tube and an electrode and, placed in front of the electrode a plate made of an electrically insulating material, where the electrode in its mounting position is disposed at a distance from the inside of the wall of the glass tube.

WO 81/01344 discloses as previously known a tubular fluorescent lamp which comprises a glass tube and an electrode that is surrounded by an electrode cover which is made of an electrically conducting material and is not electrically connected with the electrode. The electrode cover consists of a can-shaped casing with an aperture made in its bottom end for the insertion of the electrode into the interior of the can. The free end of the can is closed by a plate provided with a central hole and made of an electrically insulating material.

Tubular fluorescent lamps of the above mentioned kind are provided with electrodes, that operate alternating as cathodes and anodes, where the cathode function is the critical one with respect to service life, burning hours and product safety.

The tubular fluorescent lamp market of today is dominated by tubular fluorescent lamps that have electrodes of the so-called hot cathode type. This electrode type is provided with special emitter material which has the ability to emit electrons at relatively low temperatures and relatively small energy supply. The energy necessary for the electron emission is supplied partly through electric heating of the coil of the electrode, which may be a tungsten coil, partly from the kinetic energy of incoming gas ions (cathode function) and electrons (anode function).

Cathode voltage drop and anode voltage drop is in a working tubular fluorescent lamp of the order of magnitude of 10V, and the hottest spot on the tubular fluorescent lamp glass, that is on the glass tube, is in the vicinity of the electrodes, still without reaching such values that may jeopardize safety.

When an electrode has completely, or almost completely, lost its emitter material, the cathode voltage drop increases substantially, which means that both the number of incoming gas ions and their kinetic energy increases substantially, which leads to a dramatic increase in heat release in the actual electrode region.

As far as can be assessed, the heat energy is concentrated initially to the coil. If it melts down quickly and loses its connection with the power supply, the heat energy will be concentrated to the current supply wires which then may melt down and cause melted metal to drip down on the inside of the glass tube. In tubular fluorescent lamps according to JP 56134468 and EP 0 555 619 A1, that is, tubular fluorescent lamps that lack an electrode cover, there is nothing to prevent this. In tubular fluorescent lamps according to WO 81/01344, that is, tubular fluorescent lamps that have an electrode cover which at least partially is placed between the coil and the inside of the glass tube seen vertically when the tubular fluorescent lamp is mounted in its working position, which means horizontally or at an angle to the horizontal plane, these drops will be collected by the electrode cover, at least if you have a relatively large electrode cover as shown in this document, which cover consequently may stop the drops from reaching the inside of the surface of the glass tube.

If the coil remains intact or remains essentially in the original position for several minutes, the electrode cover itself, in those cases where there is one, will be significantly heated up. Then, when conduction heat from the electrode cover makes the glass in the sealing area soft, the electrode cover may bend down due to gravity and come into contact with the inside of the surface of the glass tube.

A crack in the glass tube may consequently be caused by melted metal drops or the hot electrode cover coming into contact with the inside of the glass tube surface. These cracks may cause the tubular fluorescent lamp to break and possibly fall out of its fittings. This phenomenon is well known under the term "Safety at end of life". Security aspects in connection with the burning out of tubular fluorescent lamps are dealt with in European and international standards concerning tubular fluorescent lamps and their operating components, under the section "Abnormal conditions".

Electrical devices that are built into tubular fluorescent lamp operating components of high frequency type with the object of preventing this increase in heat generation in the electrode region are previously known.

THE OBJECT OF THE INVENTION

The object of the invention is to prevent the tubular fluorescent lamp from falling out of its fittings at the end of its life.

THE INVENTIVE IDEA

This is achieved with a tubular fluorescent lamp, comprising:

(a) a hollow, elongated glass tube, having at least one end opening, (b) at least one tube end sealing assembly mounted in and sealing said at least one end opening and including: a base, contact pins extending out from said base, an electrode attached to said base, current supply wires connecting said electrode with said contact pins through said base, an electrode cover surrounding said electrode, (c) a spacer between the electrode cover and the adjacent inner surface of said glass tube, whereby direct contact is prevented between the electrode cover and the inner surface of the glass tube.

ADVANTAGES OF THE INVENTION

By using tubular fluorescent lamps according to the invention which prevent direct contact between the electrode cover and the inside of the glass tube, cracks in the glass tube in connection with burning out of the tubular fluorescent lamps caused by the hot electrode cover coming into contact with the inside of the glass tube are avoided. At the same time, the function of the electrode cover to prevent molten metal drops from the coil from dripping down on the inside of the glass tube surface, which may cause cracks in the glass tube, is maintained. These cracks may cause the tubular fluorescent lamp to break off and fall out of its fittings.

SHORT DESCRIPTION OF THE DRAWINGS

The invention is described in more detail below in the form of several embodiments and with reference to the attached drawings.

FIG. 1 shows in section one end of a tubular fluorescent lamp provided with an electrode cover and a spacer according to one embodiment of the invention.

Figure 2A:
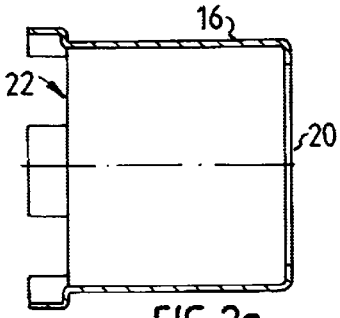
Figure 2B:
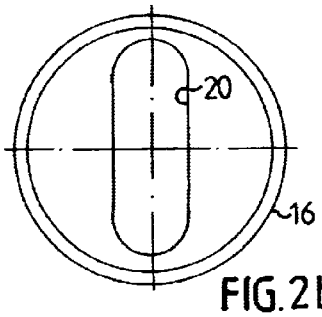

FIGS. 2*a* and 2*b* show schematically the electrode cover in FIG. 1 in longitudinal section and in an end view, respectively.

Figure 2C:
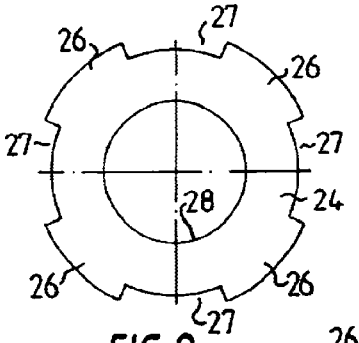

FIG. 2*c* shows in a plan view a mica plate for covering the open end of the electrode cover in FIGS. 2*a* and 2*b*.

Figure 2D:
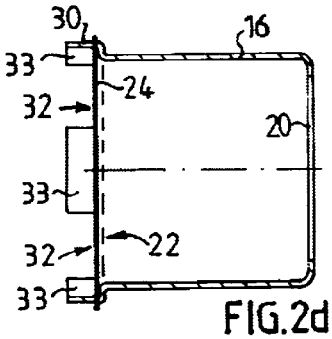
Figure 2E:
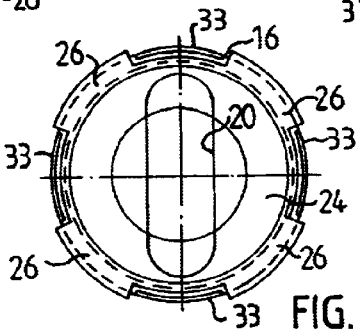

FIGS. 2*d* and 2*e* show in longitudinal section and in an end view, respectively, the electrode cover with a mounted mica plate shown in FIG. 2*c*.

Figure 3A:
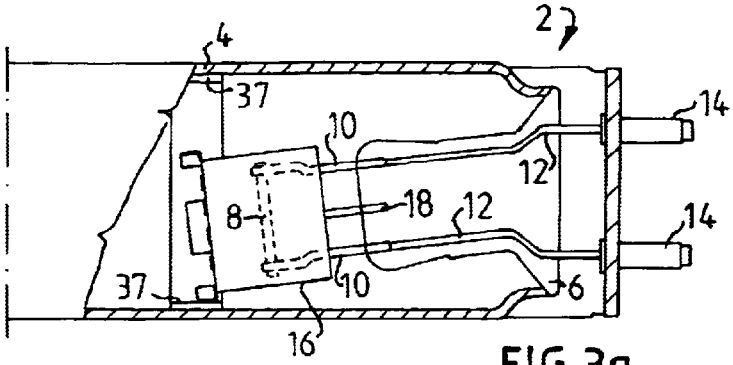

FIG. 3*a* shows a possible result of extreme heating of the glass in the sealing area of the glass tube, and another embodiment of the spacer according to the invention.

Figure 3B:
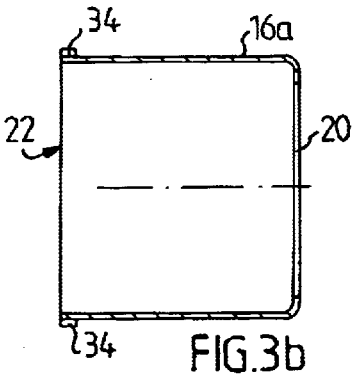
Figure 3C:
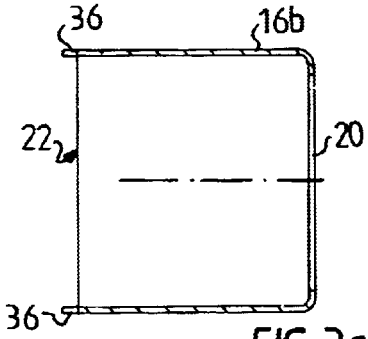

FIGS. 3*b* and 3*c* show schematically two further embodiments of the spacer.

Figure 4:
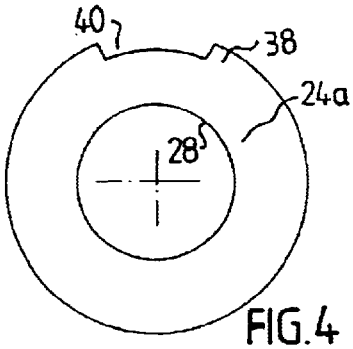

FIG. 4 shows a further embodiment of the mica plate.

Figure 5A:
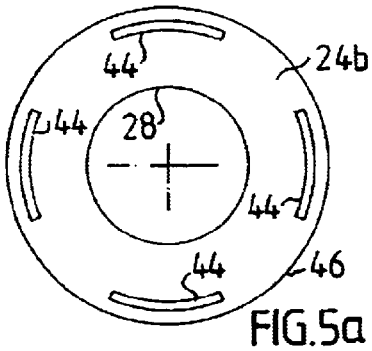

FIG. 5*a* shows another embodiment of the mica plate.

Figure 5B:
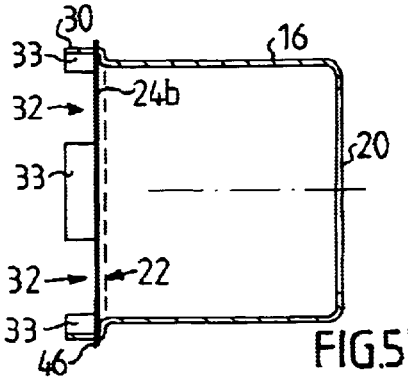

FIG. 5*b* shows in section an electrode cover with mounted mica plate according to FIG. 5*a*.

Figure 5C:
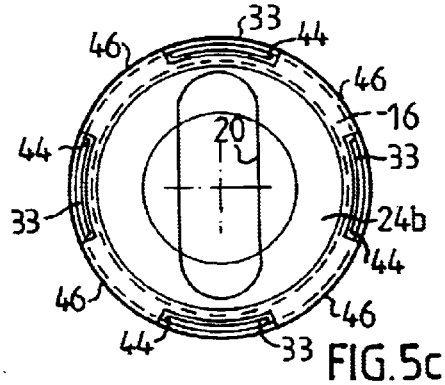

FIG. 5*c* shows in end view an electrode cover with a mounted mica plate according to FIG. 5*a*.

DETAILED DESCRIPTION

FIG. 1 shows in longitudinal section one end of a tubular fluorescent lamp 2. The glass tube 4 of the tubular fluorescent lamp 2 is sealed at its end in conventional manner with a base 6, which at the same time serves as support for the electrode supports 10 supporting an electrode 8. These supports 10, which are electrically conducting, are connected to current supply wires 12 fused into the base 6, through which current may be made to flow through the electrode 8 and heat it up. The current supply wires 12 are at their other end connected to pins 14, which are to be inserted in a power supply socket (not shown). The electrode 8 is surrounded by an electrode cover 16, which is electrically conducting and made of metal, preferably iron or nickel. The cover 16 is carried by a bar 18 fused into the base 6 and is electrically insulated from the electrode 8. With a cover 16 as above, a substantially increased reflection is obtained back to the electrode 8 surface of atoms and molecules released therefrom, both those released by ion bombardment, and those which have been evaporated from the electrode 8 surface. This results in a significant increase in the life of the tubular fluorescent lamps 2 as a consequence of decreased loss of emission material from the electrode 8.

As can be seen from FIGS. 2*a* and 2*b*, the electrode cover 16 has the shape of a cup with an elongated opening 20 made in its bottom for insertion of the electrode 8 and parts of the electrode supports 10. The open end 22 of the electrode cover is covered by a spacer 24 in the form of an electrically non-conducting plate 24, as can be seen in FIG. 2*c*, called the aperture plate. It is provided with a central opening 28 and four radial projections 26 evenly distributed about the circumference, with intermediate recesses 27. It should be pointed out that the number of projections 26 may be varied and therefore they need not necessarily be four in number or be evenly distributed. As can be seen in FIG. 2*d*, the electrode cover 16 is provided with a flange 30 provided with recesses 32. The recesses 32 are adapted to the shape of the plate 24 so that it will be possible to cover the open end 22 of the electrode cover with the plate 24 as is shown in FIGS. 2*c*–2*e*. The tongues 33 in the flange 30 fit into the recesses 27 in the plate 24 and may be bent or folded to retain the plate 24 on the electrode cover 16. The tongues 33 must be folded in such a way that they do not protrude axially (or radially) and touch the glass before the plate 24 stops the downward bending movement of the electrode cover 16 described below. Suitably, they are folded in radially, away from the periphery.

When an electrode 8 at the end of its life has completely, or almost completely, lost its emitter material, a dramatic increase in the heat release occurs in the electrode region in question, as mentioned above. The heat energy is initially concentrated to the electrode 8, which preferably is a coil of tungsten. If the electrode 8 remains intact or stays mainly in its original position for a longer period of time, for example for several minutes, the electrode cover 16 will itself become substantially heated up. When conduction heat from the electrode cover 16 makes the glass at the base 6 soft, or if the bar carrying the electrode cover 16 softens, the electrode cover 16 may bend down due to gravity, and could come into contact with the inside surface of the glass tube. Thanks to the fact that the plate 24 is provided with projections 26 that protrude outside the radial periphery surface of the electrode cover 16, the electrode cover 16 is prevented from coming into direct contact with the inside of the wall of the glass tube 4 when it is deplaced from its mounting position radially in relation to the glass tube 4. This is achieved by virtue of the fact that one part of the plate 24 lying outside the electrode cover 16 will bear against the inside of the wall of the glass tube 4 before the electrode cover 16 comes into direct contact with it. The projections 24 must extend so far that the heat energy that is stored in them will not cause cracks in the glass tube 4 when one or more projections 26 comes into contact with the inside of the wall of the glass tube 4.

As can be seen in FIG. 2*c*, the aperture plate 24 is provided with a central opening 28, preferably of circular shape. For a normal tubular fluorescent lamp with the glass tube diameter of 38 mm, the opening 28 has a diameter of preferably 10–12 mm. For a 36 mm tubular fluorescent lamp the opening is about 8 mm and for tubular fluorescent lamps with smaller diameters the opening is smaller. A smaller diameter decreases the blackening of the inside of the glass tube wall but increases at the same time the starting voltage to non-acceptable levels. Greater diameter decreases the starting voltage only insignificantly, but increases the blackening of the wall of the glass tube significantly.

As the discharge must pass through the limited opening 28 in the plate 24, a substantial increase in the density of electrons, during the half-cycles when the coil 8 is functioning as an anode, is obtained in the vicinity of the coil 8, whereby the anode drop is decreased, which results in decreased cathode temperature and thereby decreased speed of evaporation.

The plate 24 must be made of a material which is not vaporized/does not emit gases during ion bombardment, as the ion bombardment, if the plate were made of iron for example, would be the source of further pulverized material and thereby increased blackening of the inside of the wall of the glass tube. The plate 24 should have lower thermal conductivity than the electrode cover 16 and is preferably made of mica. When using a mica plate 24, its thickness is preferably 0.10–0.15 mm and it shall preferably protrude outside the electrode cover 16 by a distance within the interval 0.1–6 mm, preferably 0.5–2 mm.

FIG. 3*a* shows a possible result of elevated heating of the glass in the sealing area of the glass tube if the coil 8 remains intact or stays mainly in its original position for several minutes, and the electrode cover 16 itself is heated up substantially so that conductive heat from the electrode cover 16 makes the glass in the sealing area 6 soft and the electrode cover 16 is bent down by gravity and moves closer to the inside of the surface of the glass tube 4.

FIG. 3*b* shows a possible placing of a spacer according to the invention, where the spacer consists of a spacer 34 in the form of an annular body or coating 34 placed on the outside lateral peripheral surface of an electrode cover 16*a*.

FIG. 3*c* shows a possible placement of a spacer according to the invention where the spacer consists of a spacer 36 in the form of an annular body or coating 36 placed on the peripheral end surface of an electrode cover 16*b*.

The peripheral surface of the electrode cover 16 means in this context the peripheral surface of the electrode cover 16 in both axial and radial directions.

A spacer according to the invention may also wholly or partly protrude from the inside of the wall of the glass tube 4, and consist of a spacer 37 in the form of an annular body or coating 37 placed on the inside of the wall of the glass tube 4 as shown in FIG. 3*a*. As an alternative to the shown complete ring 37 multiple separate spacers may be arranged in a ring, protruding radially inwards from the inside of the glass tube 4 (not shown).

FIG. 4 shows a further embodiment of a spacer 24*a* in the form of an aperture plate 24*a*, that has at least one part 38 which protrudes outside the periphery surface of the electrode cover 16. The projections 26 in the plate 24 that are shown in FIG. 2*c* correspond in this case to a larger continuous part 38. The radial peripheral surface of the electrode cover 16 is in this case situated at the bottom of the recess 40. The design of the free end 22 of the electrode cover 16 may in this case be adapted to the design of the periphery of the plate 24*a*, for example so that a fastening tongue 33 fits in the recess 40.

FIG. 5*a* shows yet another embodiment of a spacer in the form of an aperture plate 24*b*. The plate 24*b* is arranged in the same way as the plate 24 shown in FIG. 2*c* with the following difference: instead of projections 26 and peripheral recesses 27 as shown in FIG. 2*c*, the plate 24*b* according to FIG. 5*a* is designed with four hole arcs 44, evenly distributed along the circumference. The protruding tongues 33 of the flange 30 are meant to be inserted through these holes 44 and then to be bent to retain the plate 24*b* on the electrode cover 16. The edge 46 of the aperture plate 24*b* protrudes radially outside the peripheral surface of the electrode cover 16.

FIGS. 5*b* and 5*c* show the plate according to FIG. 5*a* mounted on an electrode cover 16.

The device may also consist of one or several spacers placed in such a way that the electrode cover 16 is prevented from coming into direct contact with the inside of the wall of the glass tube 4 when the electrode cover is moved from its mounting position in a radial direction relating to the longitudinal axis of the glass tube 4, through direct contact arising between the electrode cover 16 and the spacer(s) and between the spacer(s) and the inside of the wall of the glass tube 4, before the electrode cover 16 comes into direct contact with the inside of the wall of the glass tube 4.

If the electrode cover 16 is provided with a metallic coating on the surface which is directed towards the electrode 8, the electrode cover itself may be made of another material than metal.

The invention may be used in normal rod shaped tubular fluorescent lamps, for example of the hot cathode type, with two caps (double capped) with different outer diameters such as for example 38 mm (t12), 26 mm (t8) and 17 mm (t5), and also in tubular fluorescent lamps of other types, for example compact tubular fluorescent lamps with one cap (single capped).

What is claimed is:

1. Tubular fluorescent lamp, comprising:

(a) a hollow, elongated glass tube, having at least one end opening (b) at least one tube end sealing assembly mounted in and sealing said at least one end opening and including:
(i) a base,
(ii) contact pins extending out from said base,
(iii) an electrode mounted in said base,
(iv) current supply wires connecting said electrode with said contact pins through said base,
(v) an electrode cover surrounding said electrode, (c) a spacer of lower thermal conductivity than the electrode cover between the electrode cover and the adjacent inner surface of said glass tube, whereby direct contact is prevented between the electrode cover and the inner surface of the glass tube.

2. Tubular fluorescent lamp as recited in claim 1, wherein the spacer is fixed to or integral with the electrode cover.

3. Tubular fluorescent lamp as recited in claim 2, wherein the spacer wholly or partly protrudes radially and/or axially outside the peripheral surface of the electrode cover.

4. Tubular fluorescent lamp as recited in claim 3, wherein the spacer consists of an electrically non-conducting plate which has at least one part that protrudes outside the peripheral surface of the electrode cover.

5. Tubular fluorescent lamp as recited in claim 4, wherein the electrode cover has the form of a cup whose bottom has an opening for insertion of the electrode, and that the open end of the electrode cover is sealed with the plate shaped spacer, preferably a mica plate, which is provided with a central opening, preferably of circular shape.

6. Tubular fluorescent lamp as recited in claim 4, wherein the plate is provided with one or several projections which protrude radially outside the peripheral surface of the electrode cover.

7. Tubular fluorescent lamp as recited in claim 4, wherein the edge of the plate protrudes radially outside the peripheral surface of the electrode cover.

8. Tubular fluorescent lamp as recited in claim 3, wherein the spacer is an annular body or coating placed on the peripheral surface of the electrode cover.

9. Tubular fluorescent lamp as recited in claim 1 wherein the spacer protrudes outside the electrode cover by a distance within the interval 0.1–6 mm, preferably 0.5–2 mm.

10. Tubular fluorescent lamp as recited in claim 1, wherein the spacer is fastened to the inside of the wall of the glass tube.

11. Tubular fluorescent lamp as recited in claim 10, wherein the spacer wholly or partly protrudes from the inside wall of the glass tube, and preferably consists of an annular body or coating placed on the inside wall of the glass tube.

* * * * *